US008068005B2

(12) United States Patent
Young et al.

(10) Patent No.: US 8,068,005 B2
(45) **Date of Patent: *Nov. 29, 2011**

(54) DIRECT WIRELESS POLLING OF MODEL TRAINS

(75) Inventors: Neil Young, Woodside, CA (US); Louis G. Kovach, II, Belleville, MI (US)

(73) Assignee: Liontech Trains LLC, Chesterfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/641,861

(22) Filed: Dec. 18, 2009

(65) Prior Publication Data

US 2010/0148938 A1 Jun. 17, 2010

Related U.S. Application Data

(63) Continuation of application No. 10/723,430, filed on Nov. 25, 2003, now Pat. No. 7,659,834.

(51) Int. Cl.
*G05B 23/00* (2006.01)

(52) U.S. Cl. ..... 340/5.1; 340/4.62

(58) Field of Classification Search ..... 340/825.72, 340/4.62, 5.64, 3.1, 4.11; 105/1, 5, 29, 23; 398/106, 156

See application file for complete search history.

(56) References Cited

U.S. PATENT DOCUMENTS 5,749,547 A * 5/1998 Young et al. ..... 246/4
6,970,096 B2 * 11/2005 Nagata et al. ..... 340/825.22
7,659,834 B2 * 2/2010 Young et al. ..... 340/825.72

* cited by examiner

*Primary Examiner* — Vernal Brown
(74) *Attorney, Agent, or Firm* — O'Melveny & Myers LLP

(57) ABSTRACT

A method and apparatus for designating a particular model vehicle for a command function without punching in the ID of the model vehicle. A remote control device is positioned near one of the model vehicles. A limited field transmission occurs between the model vehicle and the remote control device. The device may be a train engine transmitting its train ID periodically via an infrared (IR) transmission. The remote near the train automatically receives the IR transmission of the train ID, so that the next press of a command button will automatically go to that train ID without needing to punch in the ID number.

29 Claims, 4 Drawing Sheets

DIRECT WIRELESS POLLING OF MODEL TRAINS

RELATED APPLICATION DATA

This patent application is a continuation of U.S. patent application Ser. No. 10/723,430, filed Nov. 25, 2003 now U.S. Pat. No. 7,659,834.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The present invention relates to controlling model vehicles, and in particular to methods for obtaining the ID of model trains.

A variety of control systems are used to control model trains. In one system, the power to the track is increased, or decreased, to control the speed and direction of the train. Multiple trains can be controlled by providing different power levels to the different sections of the track having different trains (see, e.g., U.S. Pat. No. 5,638,522). In another system, a coded signal is sent along the track, and addressed to the desired train, giving it a speed and direction. The train itself controls its speed by converting the AC voltage on the track into the desired DC motor voltage for the train according to the received instructions. The instructions can also tell the train to turn on or off its lights, horns, etc. U.S. Pat. Nos. 5,749,547 and 5,638,522 issued to Neil Young et al. show such a system. The instructions, or commands, have a particular format for a particular model train manufacturer. Trains already in customer's hands are designed to respond to only that format, limiting the options for future expansion.

The arrival of a train on a section of track can be detected in some systems, such as by detecting the load on the current applied to the track, and can be used to activate certain elements connected to the track, such as a switch or a stoplight (see, e.g., U.S. Pat. No. 5,492,290).

U.S. Pat. No. 4,349,196 shows a system with a unique bar code on the bottom of each train car, with detectors mounted in the track below. This allows a determination of which car is over the sensor, and which cars have been assembled in a train. U.S. Pat. No. 5,678,789 shows a system with sensors in the track for detecting the position and velocity of a passing train. U.S. Pat. No. 4,970,389 describes a bar-code indicia in the windshield of a car, invisible to humans, but readable by an IR laser. IR IDs readable by scanners are common for bar coding products, access cards, and other uses.

U.S. Pat. No. 6,480,766 contains a discussion of different systems, including satellite Global Positioning Systems (GPS) for determining the location of a particular full sized (not model) train. U.S. Pat. No. 5,803,411 shows a train which detects position indicators along the side of a track, and provides these to an onboard computer for determining the position, speed, etc. of the train.

Many model train systems include a remote control for controlling different train engines on the track, as well as for controlling accessories. The remote control normally sends commands either wirelessly or through a base device connected to the tracks. The command will include an address, which the user typically has to key in before or after hitting the command button. Each engine sees the transmissions, either wirelessly, or by picking up signals sent along the tracks. Each engine will only respond to commands with the address of that engine.

BRIEF SUMMARY OF THE INVENTION

The present invention provides a method and apparatus for designating a particular model vehicle for a command function without punching in the ID of the model vehicle. The remote control device is positioned near one of the model vehicles. A limited field transmission occurs between the model vehicle and the remote control device. Data is then transmitted between the model vehicle and the remote control device.

In one embodiment, the model vehicle is a train and the train engine transmits its train ID, engine number and engine road name, and optionally other data, periodically via an infrared (IR) transmission. The present invention allows the user to place the remote near the train desired to be controlled, automatically receive the IR transmission of the train ID, so that the next press of a command button will automatically go to that train ID without needing to punch in the ID number.

The invention can also use other mechanisms, such as a transmission from the remote which is reflected off of an IR reflector or other reflector on the engine, with the ID coded on the reflector. This may be particularly useful for accessories without sophisticated electronics inside. In one embodiment, the receiver of the IR is recessed within the remote controller so that only a narrow field of view for reception is provided, avoiding the situation where the remote device picks up transmissions from other trains, which might occur if the IR receiver were allowed to widely receive in multiple directions.

For a further understanding of the nature and advantages for the invention, reference should be made to the following description taken in conjunction with the accompanying drawings.

DETAILED DESCRIPTION OF THE INVENTION

Example Control System

Figure 1:
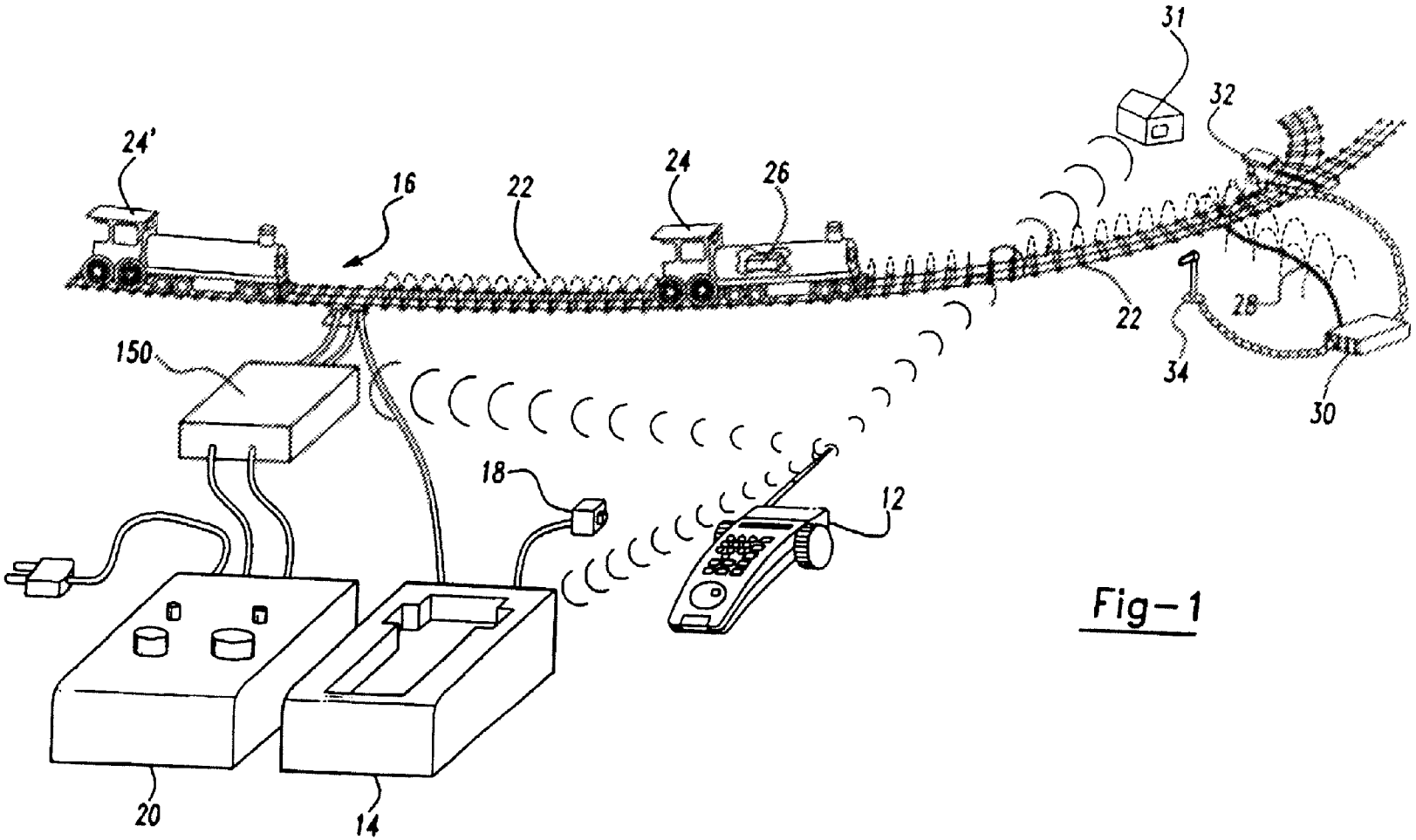
FIG. 1 is a drawing of an example layout of a train track system which could be used with the present invention.

FIG. 1 is a perspective drawing of an example layout of a train track system. A hand-held remote control unit 12 is used to transmit signals to a base unit 14 and to a power master unit 150 both of which are connected to train tracks 16. Base unit 14 receives power through an AC adapter 18. A separate transformer 20 is connected to track 16 to apply power to the tracks through power master unit 150. Power master unit 150 is used to control the delivery of power to the track 16 and also is used to superimpose DC control signals on the AC power signal upon request by command signals from the hand-held remote control unit 12.

Power master unit 150 modulates AC track power to the track 16 and also superimposes DC control signals on the track to control special effects and locomotive 24'. Locomotive 24' is, e.g., a standard Lionel locomotive powered by AC track power and receptive to DC control signals for, e.g., sound effects.

Base unit 14 transmits an RF signal between the track and earth ground, which generates an electromagnetic field indicated by lines 22 which propagates along the track. This field will pass through a locomotive 24 and will be received by a receiver 26 inside the locomotive. Locomotive 24 may be, e.g., a standard locomotive retrofitted or designed to carry a special receiver 26.

The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The remote unit can transmit commands wirelessly to base unit 14, power master unit 150, accessories such as accessory 31, and could transmit directly to train engines instead of through the tracks. Such a transmission directly to the train engine could be used for newer engines with a wireless receiver, while older train engines would continue to receive commands through the tracks.

Train Circuitry

Figure 2:
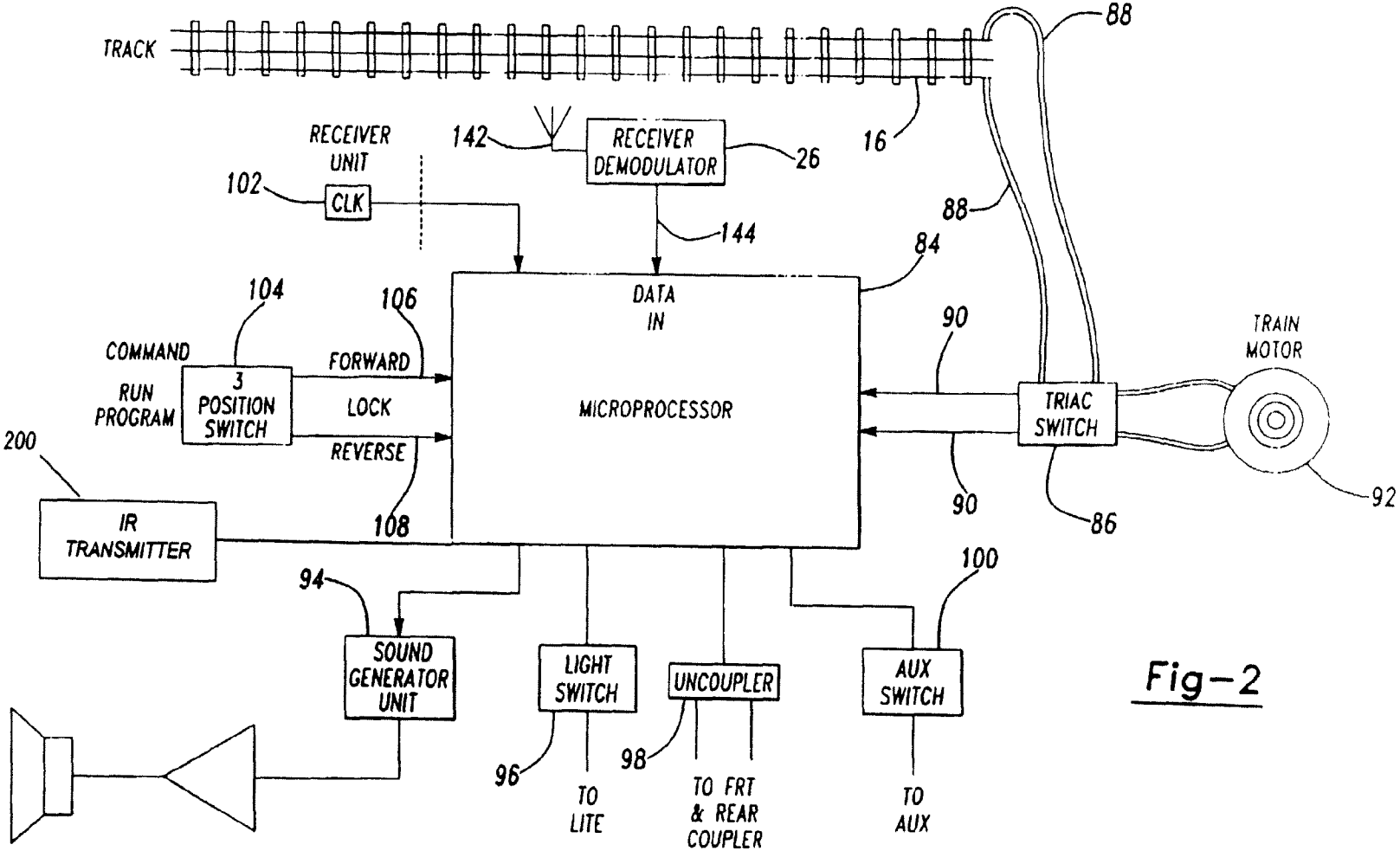
FIG. 2 is a block diagram of an example of the circuitry inside of a train according to an embodiment of the invention.

FIG. 2 is a block diagram of an example of the circuitry inside of a train 24 running on track 16. A receiver and demodulator circuit 26 picks up the electromagnetic field signals, and provides them to a data input of a microcontroller 84. The receiver can be an FM receiver chip and the microcontroller can be a microprocessor. The microprocessor controls a triac switching circuit 86. One side of the triac switches are connected to the train tracks through leads 88 which pick up power physically from the track. When activated by control signals from microcontroller 84 on lines 90, the triac switching circuit 86 will provide power to train motor 92, which moves the wheels of the train.

The microcontroller also has separate, dedicated output pins which can control a sound generator unit 94, a light switch 96, a coupler 98 and an auxiliary switch 100. The microcontroller is powered by an on-board clock 102.

A three position manual switch 104 is provided. In a first mode, the switch indicates on a line 106 that the train is to start in the forward direction. When in a second position, a signal on a line 108 indicates that the train is to start in the reverse direction. When the switch is in-between the two lines, in a "lock" mode, the microcontroller knows to start the train in the last direction it was in.

The same switch 104 can perform a second function. When a control command is received by the microcontroller, it knows to use the position of switch 104 to indicate either a "run" mode when the switch is in position 106, or a "program" mode when the switch is in the position on line 108.

In order to program an address into a train, the manual switch is moved into the program mode and the train is put on the track. The remote unit is then used to provide an address program command with a designated address for that train. This command is received by the receiver 26 and provided to microcontroller 84, which knows it should write into its memory that address as its designated address. Thereafter, in the run mode, the microcontroller will respond only to commands associated with that address.

An IR transmitter 200 is connected to the microprocessor. This transmitter periodically emits the train's information packet which includes its ID, engine number and engine road name under the control of the microprocessor.

Direct Wireless ID

Figure 3:
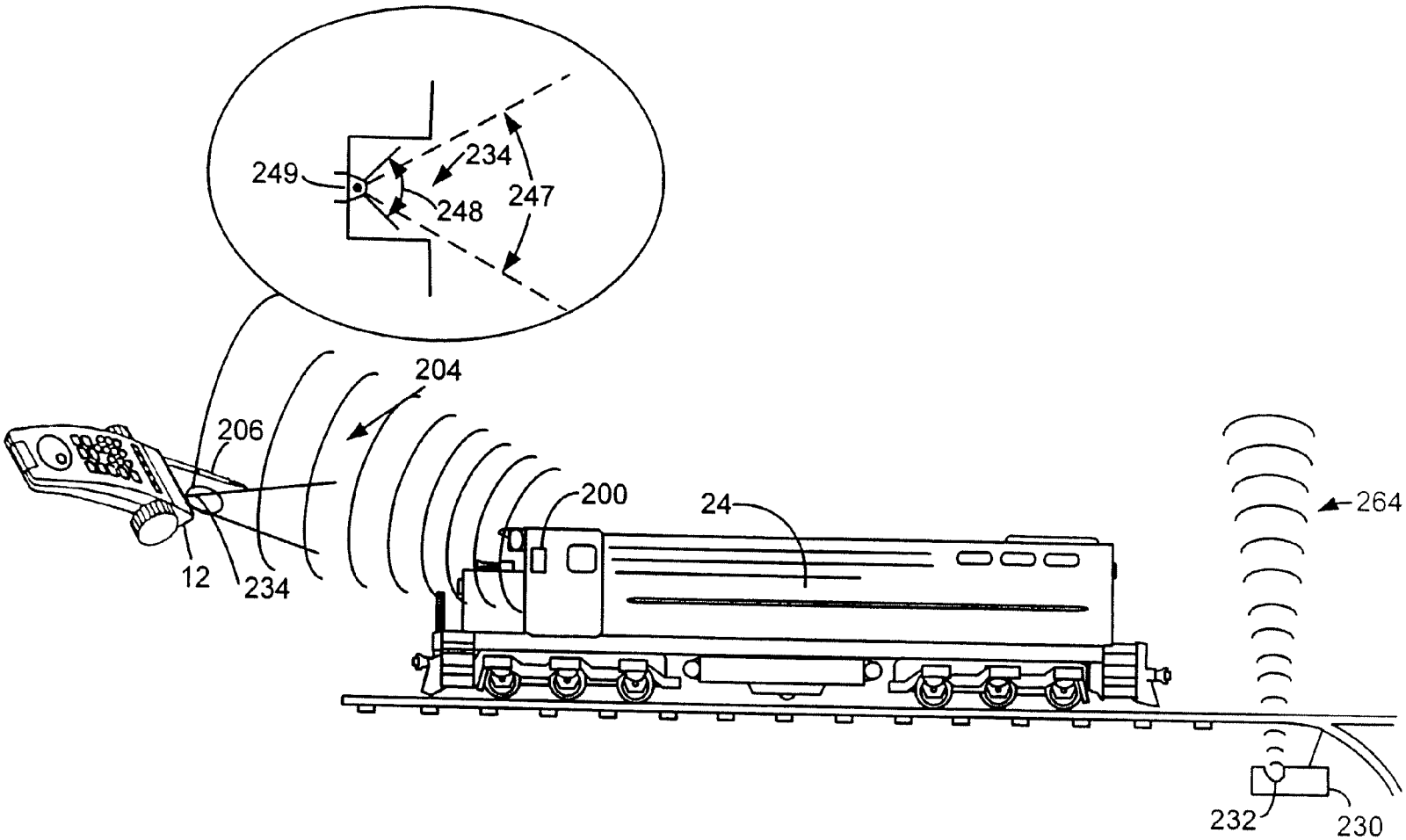
FIG. 3 is a drawing illustrating the transmission between the train and the remote according to an embodiment of the invention.

FIG. 3 illustrates a train locomotive 24 with an IR transmitter 200 mounted behind its windshield. The receiver is mounted in a recess 234 which acts to limit the field of the reception to a narrow band as illustrated by transmission lines 204. The standard viewing angle 248 of the IR receiver 249 is further limited by the use of a recess creating a further reduction in the viewing angle represented by 247. The transmission is then received by an IR receiver of remote unit 12. Alternately, the IR transmitter could be placed in other locations on the locomotive or on other cars of the train. Alternately, the transmitter could be recessed. This would be useful for RF transmission from the train engine to the remote control.

FIG. 3 also shows an example of an accessory, a switch 230 for controlling selection between two different portions of the track. The switch has its own IR transmitter 232, which can be driven by a simple integrated circuit with either DIP switches or serializing a unique number representing the encoded ID to be transmitted, or some other mechanism. Alternately, instead of a transmitter 232, a IR reflective strip with the ID code can be placed on the device, with the remote control device having a transmitter and receiver for bouncing an IR signal off of the accessory to determine its ID code.

Figure 4:
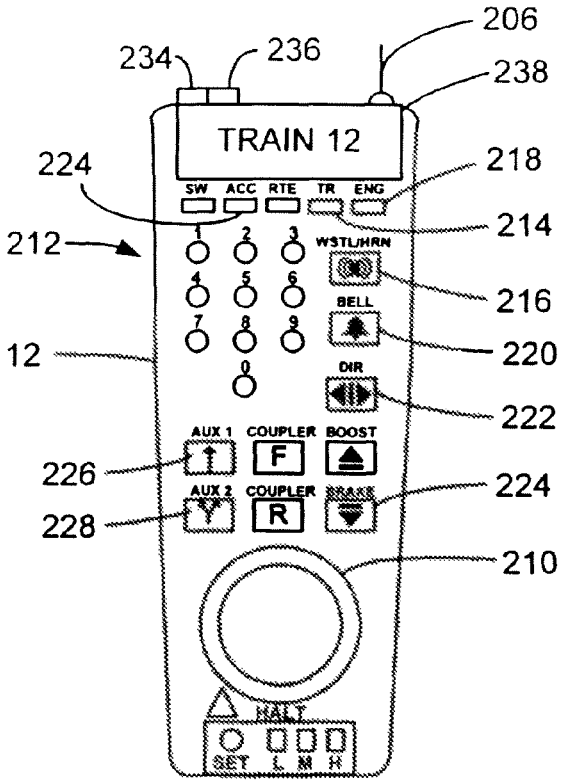
FIG. 4 is a diagram of a remote control unit which can be used in the embodiment of the invention.

FIG. 4 is a diagram of remote control device 12 illustrating some of its buttons and controls. The remote control includes a throttle dial 210 and a numeric keypad 212. A number of other control buttons are provided. For example, a train button 214 is pressed to select a particular train, with the train ID number then being punched in on the keypad 212. Once the train has been selected, certain functions of the train can be activated by pressing other buttons, such as a whistle/horn button 216, an engine button 218 for activating an engine, a bell button 220, a direction button 222 for controlling the direction of a train and a brake button 224. Also provided are an accessory button 224 which can select a particular accessory, such as a signal light or a switch. This can be selected by pressing the button, then selecting the number of the particular accessory. The functions of the accessory can then be controlled by pressing auxiliary buttons 226 and 228.

Remote control device 212 includes an IR receiver 234, and optionally a transmitter 236 for reflecting IR signals off of a reflective IR coated strip, to be detected by IR detector 234. Antenna 206 is used for RF transmissions either to a base unit or directly to trains and accessories.

In one embodiment of the invention, the user simply holds the remote close enough to the selected device (engine, accessory) so that the appropriate device has been detected. To send a command to that particular device, the user only needs to directly push one of the command buttons, selecting which type of device is being operated without entering the device ID. The ID will have been received, with the processor automatically sending that ID with the command that is transmitted. Another way of indicating the ID would be to press the learn button. This button would open the remote to look for the ID being transmitted.

In another embodiment, a display 238 is provided. In this embodiment, when the remote is pointed at a particular train, the ID would be received from the train, and the processor inside the remote will display the train ID number, as well as an alpha display indicating that it is a train, and not an accessory. Other displays could be used for accessories, such as an alpha display of the word "switch" with the switch number. Thus, the user is given visual confirmation that the appropriate train accessory has been selected, and can then directly activate one of the other buttons, such as bell button 220, directional button 222, etc.

Figure 5:
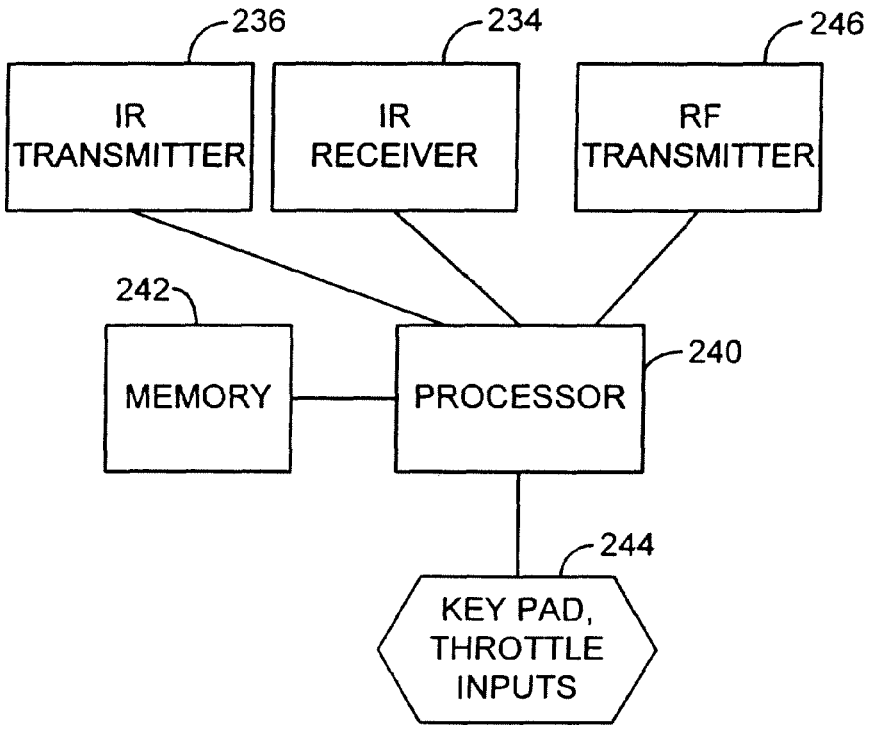
FIG. 5 is a block diagram of the electronic circuitry inside the remote control unit of FIG. 4.

FIG. 5 is a block diagram illustrating the electronics and the interior of remote control device 12 of FIG. 4. A processor 240 controls the remote control with a program stored in the memory 242. Keypad and throttle inputs 244 are provided to the microprocessor to control it. The microprocessor controls an RF transmitter 246 which connects to RF antenna 206 to transmit commands to a base unit or directly to trains and accessories. IR receiver 234 and IR transmitter 236 are also controlled by the processor.

As would be understood by those with skill in the art, the present invention may be embodied in other specific forms without departing from the essential characteristics thereof. For example, instead of an IR transmission, the transmission could be a separate RF frequency, spread spectrum, visible light, or any other wireless transmission method. Visible light might be used instead of, or in addition to the IR transmission, to visually guide the user as to where to hold the remote to intercept the ID. The user could turn the visible light function on with a control on the remote so that the light is only emitted when the user wants to select devices, so all the devices aren't flashing all the time. Accordingly, the foregoing description is intended to be illustrative, but not limiting, of the scope of the invention which is set forth in the following claims.

What is claimed is:

1. A method for identifying a first one of a plurality of devices in a model vehicle system, comprising:

positioning a remote control device near said first one of said plurality of devices while said first one of said plurality of devices remains operational in said model vehicle system;

transmitting identification (ID) information from said first one of said plurality of devices to said remote control device via a first communication channel, wherein said remote control device is only capable of receiving said ID information when said remote control device is placed within a narrow spatial field emanating from said first one of said plurality of devices with a limited viewing angle, so that said ID information is not interfered with by transmissions from other ones of said plurality of devices;

interacting with said remote control device to select a function to be performed by said first one of said plurality of devices; and transmitting a control signal from said remote control device to said first one of said plurality of devices via a second communication channel that is separate from said first communication channel, said control signal comprising:

at least a portion of said ID information, said first one of said plurality of devices being configured to execute said control signal only if said control signal comprises said at least a portion of said ID information; and function data, said function data identifying said function to be performed by said first one of said plurality of devices in response to said control signal.

2. The method of claim 1, wherein said first one of said plurality of devices comprises a model train vehicle.

3. The method of claim 2, wherein said model train vehicle comprises a train engine.

4. The method of claim 1, wherein said first one of said plurality of devices comprises a model train accessory.

5. The method of claim 4, wherein said model train accessory comprises a switch device.

6. The method of claim 4, wherein said model train accessory comprises a light device.

7. The method of claim 1, wherein said step of transmitting ID information from said first one of said plurality of devices to said remote control device further comprises periodically transmitting said ID information from said first one of said plurality of devices.

8. The method of claim 1, wherein said step of transmitting ID information from said first one of said plurality of devices to said remote control device further comprises transmitting an infrared signal from said first one of said plurality of devices.

9. The method of claim 2, wherein said step of transmitting ID information from said first one of said plurality of devices to said remote control device further comprises transmitting at least an ID number of said first one of said plurality of devices and a name of said first one of said plurality of devices.

10. The method of claim 2, wherein said step of transmitting ID information from said first one of said plurality of devices to said remote control device further comprises transmitting additional information of said first one of said plurality of devices.

11. The method of claim 4, wherein said step of transmitting ID information from said first one of said plurality of devices to said remote control device further comprises transmitting at least an ID number of said first one of said plurality of devices and a name of said first one of said plurality of devices.

12. The method of claim 4, wherein said step of transmitting ID information from said first one of said plurality of devices to said remote control device further comprises transmitting additional information of said first one of said plurality of devices.

13. The method of claim 1, wherein said step of interacting with said remote control device to select a function to be performed by said first one of said plurality of devices further comprises interacting with said remote control device to select one of a whistle, horn, bell, engine, speed, direction and brake function.

14. The method of claim 1, wherein said at least a portion of said ID information comprises an ID number of said first one of said plurality of devices.

15. The method of claim 1, further comprising interacting with said remote control device to select a learn function prior to said step of interacting with said remote control device to select a function to be performed by said first one of said plurality of devices, said learn function being used to initiate a communication of said ID information from said first one of said plurality of devices to said remote control device.

16. The method of claim 1, wherein said step of transmitting ID information further comprises initiating a communication of said ID information from said first one of said plurality of devices to said remote control device by placing said remote control device within said narrow spatial field and pointing said remote control device at said first one of said plurality of devices.

17. The method of claim 1, wherein said first communication channel is bi-directional.

18. The method of claim 17, wherein information is communicated over said first communication channel using at least one of infrared light and visible light.

19. The method of claim 17, wherein information is communicated over said first communication channel using both infrared light and visible light.

20. The method of claim 1, wherein said step of transmitting a control signal from said remote control device to said first one of said plurality of devices further comprises transmitting said control signal in response to said step of interacting with said remote control device, said step of interacting with said remote control device being a single interaction with said remote control device.

21. The method of claim 1, further comprising displaying data corresponding to said first one of said plurality of devices on said remote control device, said ID information comprising at least said data.

22. The method of claim 21, wherein said data comprises at least a name of said first one of said plurality of devices.

23. A method for identifying a first one of a plurality of devices in a model vehicle system, comprising:

positioning a remote control device near said first one of said plurality of devices while said first one of said plurality of devices remains operational in said model vehicle system;

transmitting identification (ID) information from said first one of said plurality of devices to said remote control device via a first communication channel, wherein said remote control device is only capable of receiving said ID information when said remote control device is placed within a narrow spatial field emanating from said first one of said plurality of devices with a limited viewing angle, so that said ID information is not interfered with by transmissions from other ones of said plurality of devices;

displaying at least a portion of said ID information on said remote control device in response to said remote control device receiving said ID information;

interacting with said remote control device to select a function to be performed by said first one of said plurality of devices; and transmitting a control signal from said remote control device to said first one of said plurality of devices, said control signal comprising:

an ID number of said first one of said plurality of devices, said ID information comprising at least said ID number, said first one of said plurality of devices being configured to execute said control signal if said control signal comprises said ID number; and function data, said function data identifying said function to be performed by said first one of said plurality of devices in response to said control signal.

24. The method of claim 23, wherein said step of displaying at least a portion of said ID information on said remote control device further comprises displaying a name of said first one of said plurality of devices on said remote control device.

25. The method of claim 23, wherein said step of transmitting a control signal further comprises transmitting said control signal from said remote control device to said first one of said plurality of devices via a second communication channel that is separate from said first communication channel.

26. The method of claim 23, wherein said step of transmitting ID information from said first one of said plurality of devices to said remote control device further comprises transmitting said ID information via an infrared signal.

27. The method of claim 23, wherein said step of transmitting ID information from said first one of said plurality of devices to said remote control device further comprises transmitting at least said ID number and a name of said first one of said plurality of devices.

28. The method of claim 23, wherein said step of transmitting a control signal from said remote control device to said first one of said plurality of devices further comprises transmitting said control signal in response to said step of interacting with said remote control device, said step of interacting with said remote control device being a signal interaction with said remote control device.

29. A method for identifying a model train in a model train system, comprising:

positioning a remote control device near said model train while said model train is positioned on a track of said model train system;

transmitting an infrared signal from said model train to said remote control device via a first communication channel, wherein said remote control device is only capable of receiving said infrared signal when said remote control device is placed within a narrow spatial field of said infrared signal, and said infrared signal comprises identification (ID) information of said model train;

displaying at least a first portion of said ID information on said remote control device in response to said remote control device receiving said infrared signal;

interacting with said remote control device to select a function to be performed by said model train; and transmitting a control signal from said remote control device to said model train via a second communication channel that is separate from said first communication channel, said control signal comprising:

at least a second portion of said ID information, said model train being configured to execute said control signal only if said control signal comprises said second portion of said ID information; and function data, said function data identifying said function to be performed by said model train, said function being performed by said model train in response to said control signal.

* * * * *